US006098798A

United States Patent [19]

Abbott et al.

[11] Patent Number: 6,098,798

[45] Date of Patent: Aug. 8, 2000

[54] CONTAINER FOR FLOOR BOX WITH INTEGRAL TEMPORARY COVER

[75] Inventors: Brian Abbott, Marcellus; Michael Zaferakis, Liverpool; David Dowd, North Syracuse; James Osterbrock, Central Square, all of N.Y.

[73] Assignee: Pass & Seymour, Inc., Solvay, N.Y.

[21] Appl. No.: 09/290,043

[22] Filed: Apr. 12, 1999

[51] Int. Cl.[7] ..... B65D 77/22; B65D 17/28

[52] U.S. Cl. ..... 206/321; 206/216; 229/242

[58] Field of Search ..... 206/216, 321, 206/701; 229/103, 123.2, 240–242; 174/66

[56] References Cited

U.S. PATENT DOCUMENTS

| | | | |
|---|---|---|---|
| 2,115,673 | 4/1938 | Stompe | 229/242 X |
| 2,152,079 | 3/1939 | Mott | 229/242 X |
| 3,181,767 | 5/1965 | Starkey | 229/242 X |
| 3,207,411 | 9/1965 | Farquhar | 229/242 X |
| 3,315,875 | 4/1967 | Praetorius | 229/242 |
| 5,420,775 | 5/1995 | Kusmer | 206/216 X |

FOREIGN PATENT DOCUMENTS

| | | | |
|---|---|---|---|
| 2282773 | 3/1976 | France | 229/242 |
| 2008542 | 6/1979 | United Kingdom | 229/242 |

*Primary Examiner*—Bryon P. Gehman

*Attorney, Agent, or Firm*—Harter, Secrest & Emery LLP; Stephen B. Salai, Esq.; Brian B. Shaw, Esq.

[57] ABSTRACT

A package for an electrical floor box of the type adapted to be mounted in a sub-floor for receiving a wiring device to allow connection to an electrical circuit includes a cardboard container having a size sufficient to permit the floor box to be contained therein, a reclosable flap for allowing the cardboard container to be opened for receiving the floor box and closed to enclose the floor box in the cardboard container, and indicia on the surface of the cardboard container defining the perimeter of a portion of the box adapted, when separated from the remainder of the container and folded, to form a temporary cover for the floor box for at least partially closing the container.

18 Claims, 3 Drawing Sheets

CONTAINER FOR FLOOR BOX WITH INTEGRAL TEMPORARY COVER

BACK GROUND OF THE INVENTION

This invention relates generally to packages for electrical wiring devices, and more particularly to a package for a floor box that includes an integral, separable temporary cover for protecting the floor box between the time it is installed and the time an electrical outlet or the like is installed in the box and the box closed.

Floor boxes for mounting wiring devices flush with the surface of floors in buildings are well known. Typically, such floor boxes include a body portion that is mounted in the sub-floor prior to the installation of a floor covering such as wood, carpeting, tile or the like. After the body of the floor box is mounted in the sub-floor, the floor is completed by applying the covering. A wiring device is installed in the body of the floor box, and the floor box is closed by installing a trim piece that extends through the floor covering into appropriately sized recesses in the floor box body to form a seal.

It is a problem with installations of the type described that there is a substantial period of time between the installation of the body of the floor box in a sub-floor and the closing of the box by installing a wiring device and subsequently installing the trim piece in the floor box, during which debris may collect in the body of the floor box from subsequent construction activities in the room in which the floor box is mounted.

The debris must either be removed, because, if allowed to remain in the floor box, it could create a hazard or at least present an unsightly appearance.

One solution to the foregoing problem is to find something with which to cover the floor box and temporarily secure it in place. A scrap of construction material secured with tape or the like could be used, but this is an undesirable solution since an appropriate piece of material may not always be available, and even if available, might be dislodged during subsequent construction.

It is an object of this invention to provide a solution for the foregoing problem.

It is a specific object of the invention to provide a container for the floor box that includes an integral temporary cover that can be placed over the body of the floor box after it is installed to substantially close the floor box until a wiring device is mounted in the floor box and a trim piece is installed to cover the floor box. It is another object of this invention to provide a temporary cover that can be easily separated from the container for the floor box with simple tools readily available, such as a knife.

It is still another object of the invention to provide such a temporary cover that does not significantly increase the cost of the container for the floor box.

Briefly stated, and in accordance with a presently preferred embodiment of the invention, a package for an electrical floor box of the type adapted to be mounted in a sub-floor for receiving a wiring device to allow connection to an electrical circuit includes a cardboard container having a size sufficient to permit the floor box to be contained therein, a reclosable flap for allowing the cardboard container to be opened for receiving the floor box and closed to enclose the floor box in the cardboard container, and indicia on the surface of the cardboard container defining the perimeter of a portion of the box adapted, when separated from the remainder of the container and folded, to form a temporary cover for the floor box for at least partially closing the container.

In accordance with another aspect of the invention, instructions are printed on the cardboard container for separating a portion of the container defined by the indicia from the remainder of the container.

In accordance with still another aspect of the invention, the indicia are on the reclosable flap of the cardboard container.

In accordance with still another aspect of the invention, the portion of the container separable from the remainder of the container is defined at least in part by a line of weakness generally coincident with the indicia, so that the temporary cover can be removed from the cardboard container without tools.

In accordance with a further aspect of the invention, the line of weakness is a line of perforations and the temporary cover is separated from the remainder of the cardboard container by tearing along the line of perforations.

In accordance with a still further aspect of the invention, the portion of the container defined by the indicia comprises a central rectangular area having a pair of rectangular lateral wings, the central rectangular area sized to substantially cover at least a portion of the floor box and the lateral wings adapted to engage openings in the floor box for securing the temporary cover in place.

In accordance with another embodiment of the invention, a method for temporarily covering an opening in a floor box includes the steps of providing a floor box in a cardboard container having indicia on the container defining the perimeter of a portion of the container adapted, when separated from the container and folded, to form a temporary cover for the floor box for at least partially closing the floor box, and separating the portion of the container defined by the indicia from the remainder of the container, and covering the floor box with the portion of the container defined by the indicia.

In accordance with another aspect of the method of the invention, instructions are provided on the cardboard container describing a method of separating the portion of the container defined by the indicia from the remainder of the container.

In accordance with another aspect of the method of this invention, covering the floor box with the temporary cover comprises the step of folding a portion of the container defined by the indicia to form a flap for insertion into a corresponding portion of the floor box.

BRIEF DESCRIPTION OF THE DRAWINGS

The novel aspects of the invention are set forth with particularity in the appended claims. The invention itself, together with further objects and advantages thereof may be more readily comprehended by reference to the following detailed description of a presently preferred embodiment of the invention taken in conjunction with the accompanying drawing in which:

DETAILED DESCRIPTION OF THE PREFERRED EMBODIMENT OF THE INVENTION

Figure 1:
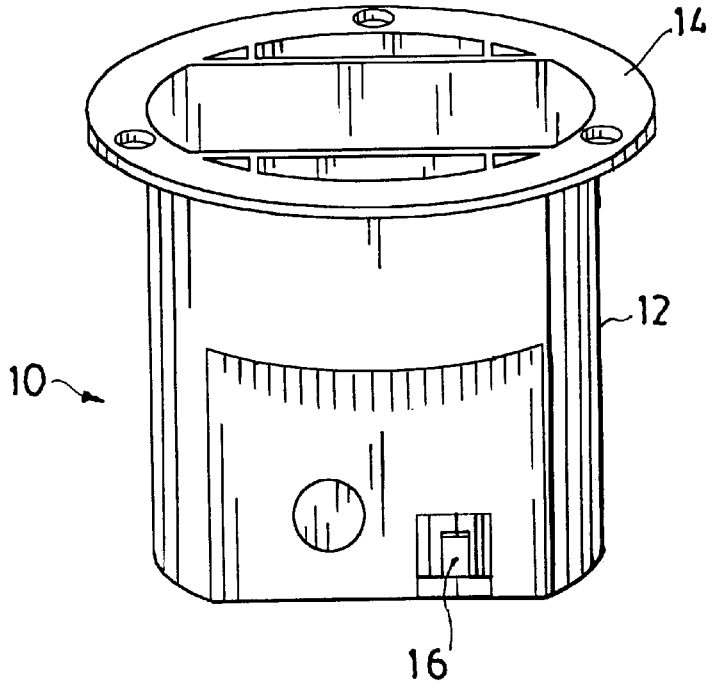
FIG. 1 is a perspective view of the body portion of the floor box of the type to which this invention pertains.

Referring now to FIG. 1, a floor box of the type to which this invention pertains is illustrated in a perspective view. The floor box 10 includes a hollow body portion 12 adapted to receive an electrical wiring device such as a receptacle connected to an electrical circuit or the like, and a flange 14 for supporting the floor box on the surface of a sub-floor which can be a wooden sub-floor in a residential structure, or a concrete sub-floor in a commercial structure. The floor box includes openings 16 through which an electrical cable may be passed for connecting a wiring device to an electrical circuit.

During construction, it is customary to install the floor box in the sub-floor prior to installation of the final floor covering, which may be carpeting, wood flooring, tile, or any other material customary in the trade. During the time between installation of the floor box and completion of the construction, debris tends to fall into the floor box and accumulate. Preferably the debris is removed from the floor box before a wiring device is installed therein, and this requires an extra operation and possibly extra equipment such as a vacuum cleaner or the like. Although the floor box could be covered with a piece of scrap material to prevent or reduce the amount of debris falling into the box, a suitable piece of material is not always available and therefore this is an undesirable approach.

Figure 2:
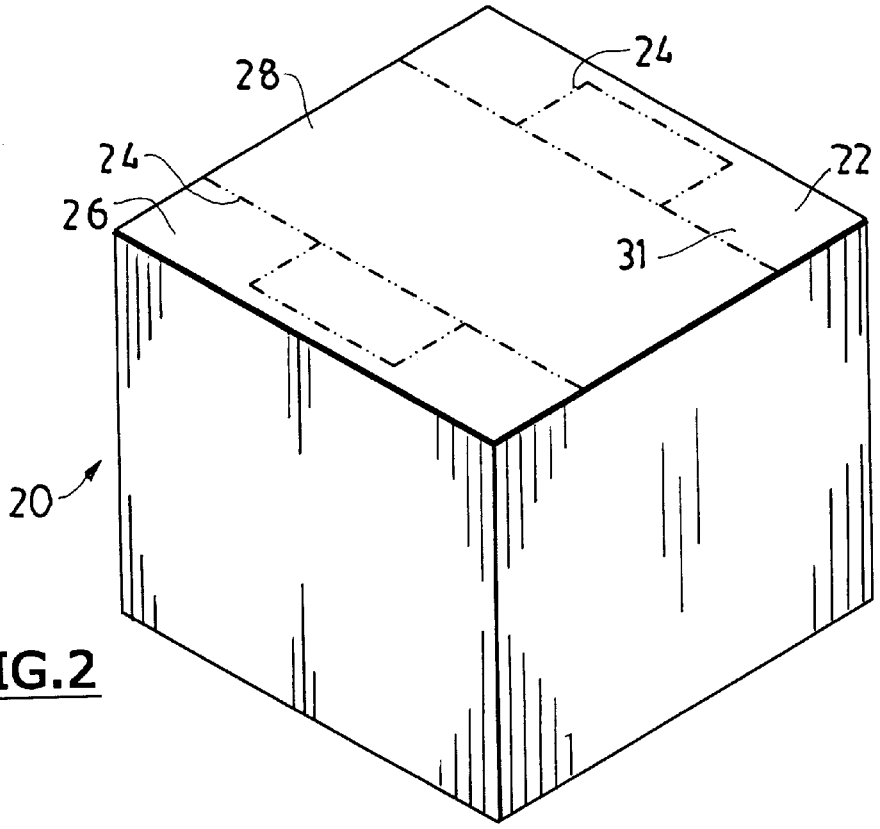
FIG. 2 is a perspective view of a container for the floor box of FIG. 1.

In accordance with the invention, a container 20 for the floor box such as the one shown in FIG. 2 is provided. The container, preferably a cardboard container of otherwise conventional construction includes a reclosable flap that can be opened by the manufacturer to insert the floor box into the container and then resealed for shipping, storage or the like. The container may have other flaps of conventional design, and the conventional aspects of the container form no part of this invention except in combination with the other elements hereof, as will be described below.

The container 20 according to the invention includes indicia 24 inscribed on a surface 26 of the container 20 preferably on the flap 22 defining the perimeter of a removable portion 28 of the container that can be formed into a temporary cover for the floor box preferably, instructions 29 are printed on the container for separating a portion of the container identified by the indicia from the remainder of the container.

Figure 3:
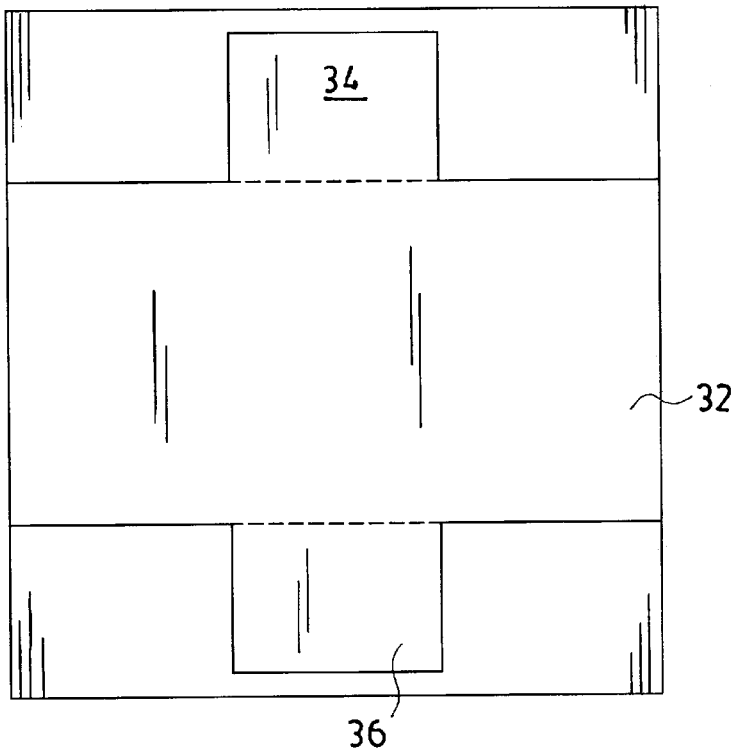
FIG. 3 is a plan view of a portion of the container of FIG. 2 showing indicia defining a temporary cover.
Figure 4:
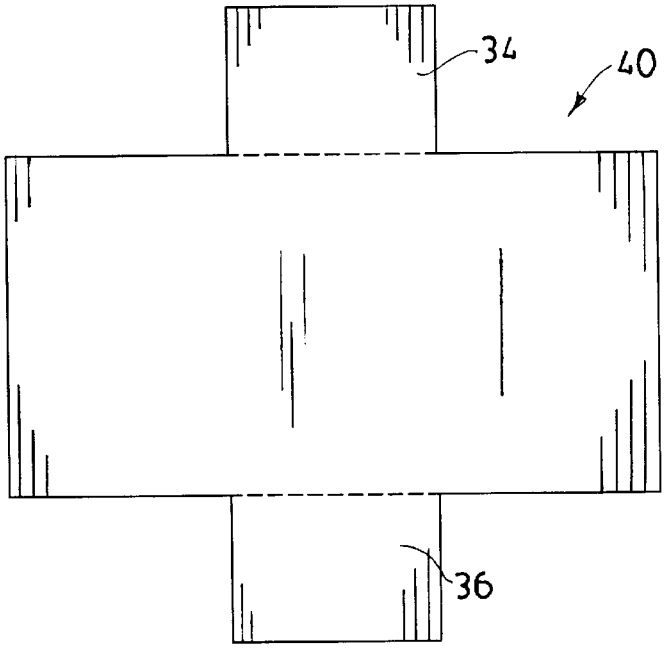
FIG. 4 is a plan view of the temporary cover removed from the remainder of the container for the floor box.

More specifically, and referring now to FIG. 3, the indicia 24 defines a central generally rectangular portion 32 sized to substantially cover the open portion of the floor box. The generally rectangular center portion comprises substantially the entire width of the closable top flap of the cardboard container of FIG. 2, this being a result of the relative size of the container and the floor box. First and second flaps or wings 34, 36 are attached to opposite edges of the rectangular portion of the disposable cover, as defined by the indicia. The width of the wings taken together with the width of the rectangular portion is substantially equal to the width of the reclosable flap 22 from which the removable cover is separated. The width of the generally rectangular center portion is less than the width of the flap by a substantial margin, but is sufficiently wide to cover the open portion of the floor box, as can be seen in FIG. 5.

In accordance with one embodiment of the invention, the indicia are merely printed on the surface of the container as part of the labeling process. A removable cover defined by the printed indicia can be separated from the remainder of the container by cutting with a knife or scissors or the like, or by carefully tearing along the periphery of the removable cover, guided by the indicia.

In accordance with another embodiment of the invention, separating the removable cover from the remainder of the container may be simplified by providing one or more lines of weakness 31 generally coincident with at least portions of the indicia. Lines of weakness may be formed by spaced perforations, scoring or any other technique well known to those skilled in the art. As so formed, the temporary cover may be removed from the remainder of the container more readily, without tools, for example by tearing along the line of weakness. Obviously a knife, scissors or the like may still be used if a line of weakness is provided, but such tools are not required.

Figure 5:
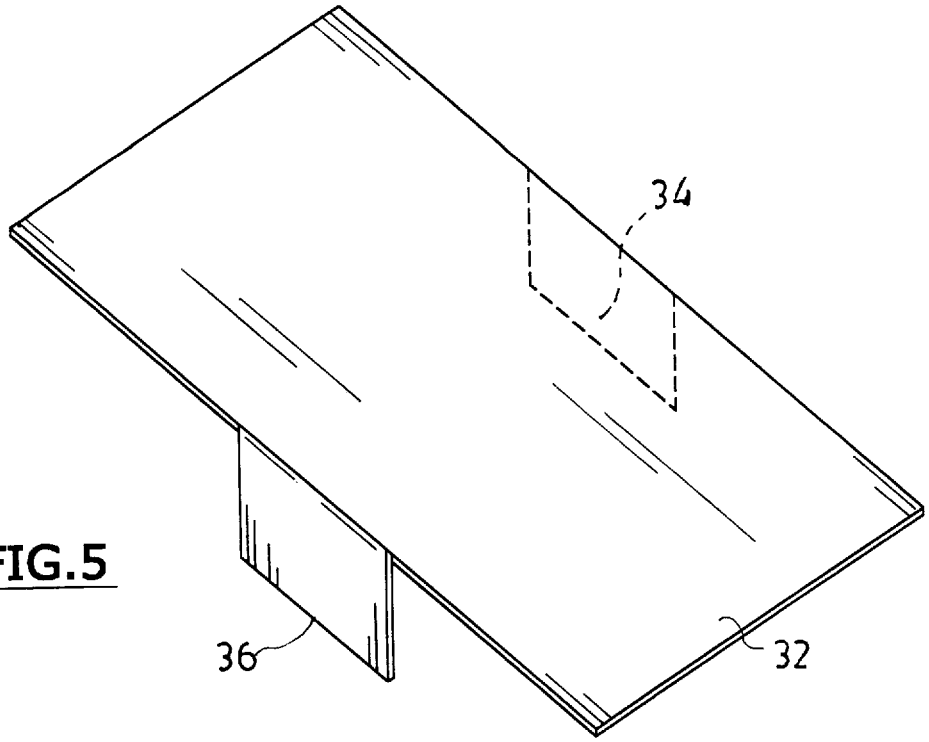
FIG. 5 is a perspective view of the temporary cover with flap portions thereof folded relative to the body of the temporary cover.
Figure 6:
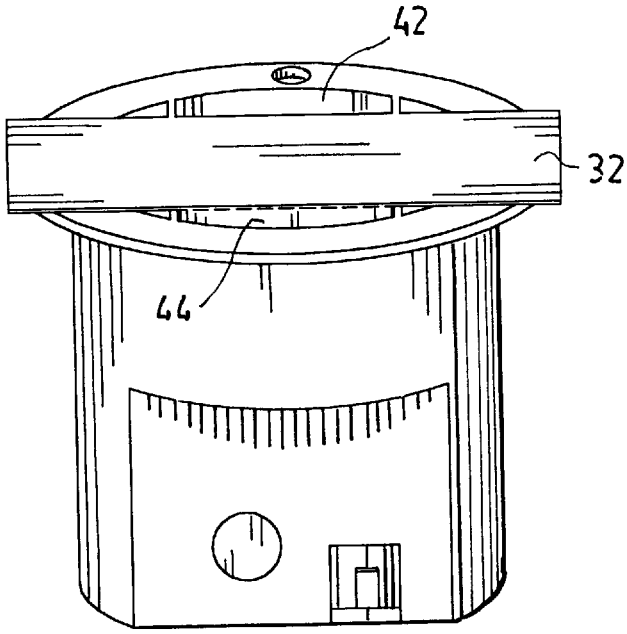
FIG. 6 is a perspective view of the temporary cover installed in the floor box.

Once the temporary cover 40 has been separated from the remainder of the container by cutting or tearing along the lines indicated by the indicia, the temporary cover is formed into a U-shape by bending the wings 34, 36 relative to the rectangular central body portion 32, as shown in FIG. 5 As so formed, the temporary cover may then be attached to the floor box by inserting the wings into openings 42, 44 in the floor box adjacent the central cavity thereof, in which the wiring devices are mounted. The natural resilience of a cardboard or other material from which the container is formed, such as plastic, recycled plastic or paper material or the like causes the wings to expand from their folded positions into engagement with the sides of the cavities in the floor box in which they are inserted, thereby holding the temporary cover in place without the need for tape, adhesives or the like.

Where the floor box, as is commonplace, has a generally round configuration, the wings may be formed to substantially exclude debris from the cavities in which they are placed, specifically by arranging the indicia to form round ends on the wings, which are sized to engage the rounded inner periphery of the cavities into which the wings are inserted.

In accordance with another aspect of the invention, additional indicia may be optionally provided for describing a fold line on the wings. If the wings are folded along this line, they form a V-shaped member which may be inserted into the opening in the floor box adjacent the main cavity to even more securely anchor the temporary cover to the floor box and provide the additional advantage of improved protection against debris re-entering the openings adjacent the main cavity.

While the invention has been described in connection with certain presently preferred embodiments thereof, those skilled in the art will recognize that many modifications and changes may be made therein without departing from the true spirit and scope of the invention, which accordingly is intended to be defined solely by the appended claims.

What is claimed is:

1. A package, for an electrical floor box having a hollow body portion and openings, the package comprising:

a container having a size to contain the floor box therein;

a flap for allowing the container to be opened for receiving the floor box, and closed to seal the floor box in the container;

a temporary cover, integral with separable therefrom the cover the container and having a central portion having a size to substantially cover the hollow body portion of the floor box, and extending from opposed edges of the central portion , each way having a size smaller than a respective opening in the floor box; and indicia on a surface of the container defining the perimeter of the temporary cover.

2. The package of claim 1 comprising instructions printed on the container for separating the temporary cover defined by the indicia from the remainder of the container.

3. The package of claim 1 in which the instructions are printed on the container adjacent to the indicia.

4. The package of claim 1 in which the indicia are on the flap of the container.

5. The package of claim 1 comprising a line of weakness formed in the container, substantially coincident with at least a portion of the indicia.

6. The package of claim 5 in which the line of weakness is a line of perforations.

7. The package of claim 5 in which the line of weakness is a scored line.

8. The package of claim 1 in which the central portion comprises a rectangular area.

9. The package of claim 1 in which the wings comprise curved ends for engaging a curved portion of an inner periphery of the floor box.

10. A method temporarily covering an opening in a floor box comprising:

providing a floor box in a container having an indicia on the container, the indicia defining the perimeter of a portion of the container that when separated from the container and folded forms a temporary cover for the floor box for at least partially closing the floor box;

removing the floor box from the container;

separating a portion of the container defined by the indicia from the remainder of the container; and covering the floor box with the separated portion of the container defined by the indicia.

11. The method of claim 10 comprising the step of providing instructions on the container describing a method of separating the portion of the container defined by the indicia from the remainder of the container.

12. The method of claim 11 comprising the step of providing instructions on the container describing a method of covering the floor box with the portion of the container defined by the indicia.

13. The method of claim 12 comprising the step of folding a portion of the portion of the container defined by the indicia to form a flap.

14. The method of claim 13 comprising inserting the flap in a portion of the floor box, to hold the temporary cover in place.

15. The method of claim 14 comprising removing the temporary cover and installing a wiring device in the floor box.

16. The method of claim 10 in which the step of separating the portion of the container defined by the indicia from the remainder of the container comprises cutting along the indicia.

17. The method of claim 10 comprising providing a line of weakness coinciding at least in part with the indicia.

18. The method of claim 17 in which the step of separating the portion of the container defined by the indicia from the remainder of the container comprises tearing the container along the line of weakness.

* * * * *